United States Patent [19]

Dove

[11] Patent Number: 4,692,213

[45] Date of Patent: Sep. 8, 1987

[54] ADJUSTMENT DEVICE FOR A LIP OF A HEADBOX SLICE

[76] Inventor: Norman F. Dove, 1144 Hilary Place, North Vancouver, B.C., Canada, V7J 3N6

[21] Appl. No.: 689,650

[22] Filed: Jan. 8, 1985

Related U.S. Application Data

[63] Continuation-in-part of Ser. No. 363,307, Jun. 25, 1984, abandoned.

[51] Int. Cl.[4] ..... D21F 1/02; D21F 1/06

[52] U.S. Cl. ..... 162/259; 162/347; 60/530; 92/34

[58] Field of Search ..... 162/347, 259, 344; 60/530; 92/34, 130 A

[56] References Cited

U.S. PATENT DOCUMENTS

| | | | |
|---|---|---|---|
| 2,928,464 | 3/1960 | Western et al. | 162/347 |
| 3,261,893 | 7/1966 | George et al. | 162/347 |
| 3,475,904 | 11/1969 | Hayes | 60/530 |
| 3,805,528 | 4/1974 | Huebscher | 60/530 |
| 4,070,859 | 1/1978 | Sobecks | 60/530 |
| 4,358,342 | 11/1982 | Nutall | 162/259 |

*Primary Examiner*—Steve Alvo

[57] ABSTRACT

A control mechanism for a lip of a headbox slice. A first vessel contains a substantially incompressible liquid. The temperature of the incompressible liquid can be varied. An expansible member communicates with the first vessel and is also full of a substantially incompressible liquid. Thus increasing the temperature of the incompressible liquid in the first vessel expands liquid from the first vessel towards the expansible member to expand that member.

7 Claims, 6 Drawing Figures

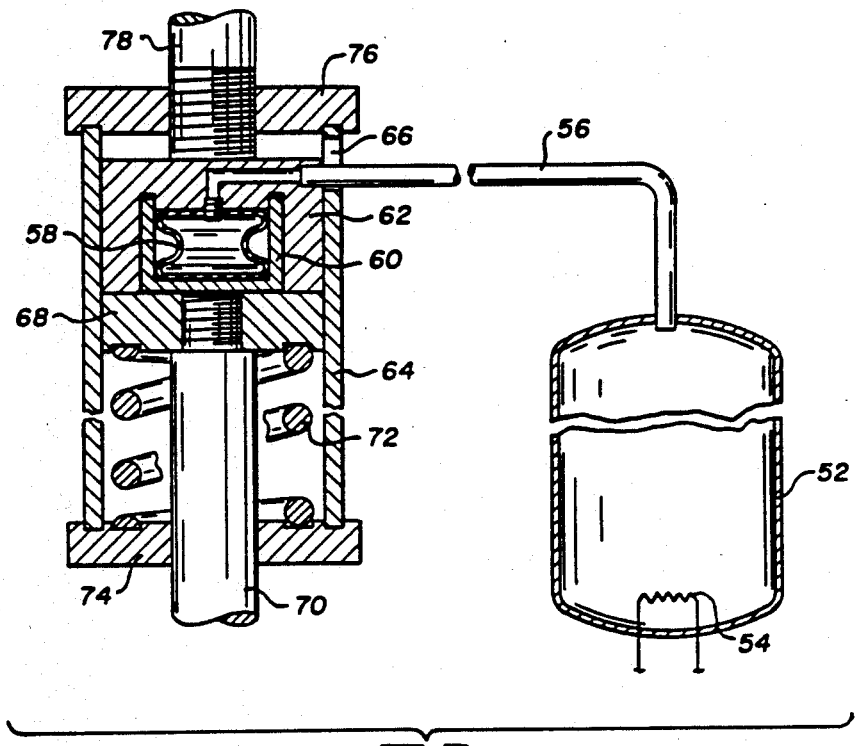
Fig. 3.
Fig. 4.
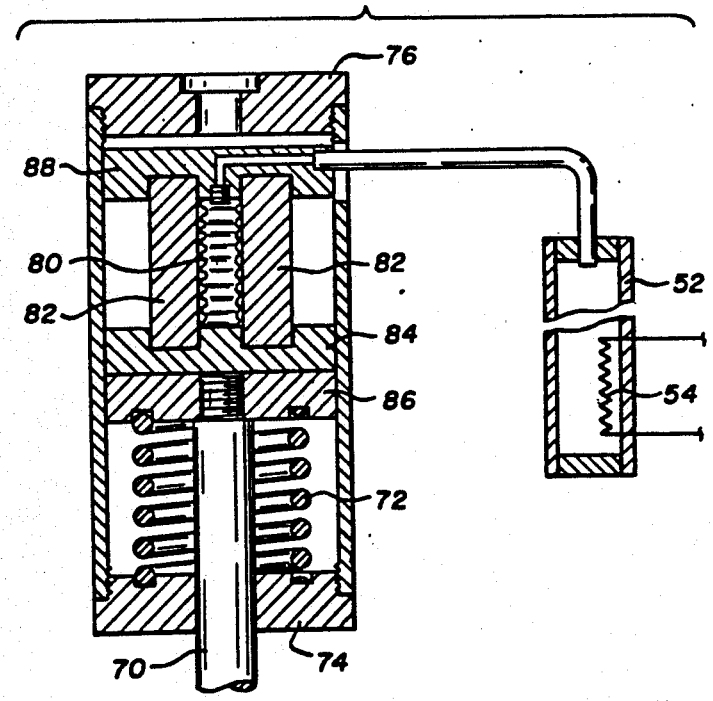

ADJUSTMENT DEVICE FOR A LIP OF A HEADBOX SLICE

This application is a continuation-in-part of Ser. No. 363,307, filed June 25, 1984, and now abandoned.

FIELD OF THE INVENTION

This invention relates to a control mechanism useful in all circumstances where a sensitive, reproducible control of a mechanism is required but of particular application as a head box slice lip control on a paper machine.

Sensitive adjustment, to less than thousandths of an inch, is frequently required in many industrial processes. The following description will be directed to the particular problem of the fine control of the slice lip of a paper machine head box but the skilled man will appreciate immediately that the invention is applicable in any circumstances where precise control is required.

DESCRIPTION OF THE PRIOR ART

The essence of the paper making machine is the wire section upon which the paper sheet is formed. A great deal of highly complex technology is practised upon the sheet after its formation on the wire but the essence of the machine remains the formation of the paper sheet. The fibre suspension that forms the paper sheet is applied to the wire section through a head box. Head boxes are now of considerable complexity but their function can be stated simply; to convert a flow of a fibre suspension into a flat jet of uniform consistency, velocity, direction and thickness and to deliver the suspension uniformly across the wire section. The delivery from the head box to the wire section takes place at a slice nozzle arrangement consisting of two lips. Normally one lip is fixed although it may be movable in the direction of the flow. The second or upper lip is normally attached to a movable front wall of the head box so that it may be moved substantially perpendicularly to the flow direction, that is to widen or narrow the gap formed by the lips.

This perpendicular movement is necessary to control the outlet jet velocity by controlling the open area of the nozzle. Movement in the direction of the flow, when present, controls the angle of impact of the jet onto the wire section.

In addition it is usual to provide the movable lip with means to control the thickness of the jet across the width of the slice. This is normally done by mechanically deforming the flexible lip at points at approximately 4 to 12 inch intervals across the width of the slice.

Typically the deformation is achieved by several rods attached at one end to the flexible lip and connected to a fixed object. The effective length of the rod, and thus the deflection of the corresponding part of the slice lip, is changed by means of a screw jack attached to the rod. By varying the length of the rods across the width of the slice nozzle the lip contour and thus the slice opening profile, that is the configuration of the slice opening in the cross machine direction, can be varied.

The degree of control obtainable with this kind of arrangement is restricted by the threads of the screw jack assembly, by backlash in the connection to the slice lips, backlash due to wear of the threads and, where motorized drive of the screw jack is used, by backlash in the drive and in the coupling.

It is important to have fine control of the slice lip contour. Because of thermal expansion and, partly, due to built in stress in the construction material used for the lips and the walls, when the temperature changes, for example during machine start up, unacceptable flexing and buckling of the lips can occur. This has to be corrected in order to produce a jet of uniform thickness and velocity and a paper of acceptably uniform fibre and moisture distribution across the width of the machine.

Although the average basis weight over the width of the machine is fairly insensitive to jet velocity, or to average slice opening, and mainly a function of head box stock consistency, this is not the case for local variations in slice openings across the width of the nozzle. These local variations will act as local flow restrictions without a corresponding local build up of head box pressure. This results in the deposition of a thinner jet, that is with less fibres, and thus variations in the sheet basis weight across the width.

Imperfections in the design of the head box can give rise to unwanted effects in the flow in the head box leading to the slice region. This can include cross machine variations in consistency, velocity, and flow direction, all of which may pass out through the slice in a more or less dampened form. It is essential to have a slice lip contour adjustment to be able to combat these defects.

Increased paper machine width, increased paper machine speeds and more stringent specifications concerning unformity of paper have in recent times put more demand on the performance of cross machine controls for paper basis weight. This has led to computer control of sheet basis weight although computer control of basis weight has until recently generally been restricted to the machine-directional control by the control of head box consistency. However, recently systems have been developed for the computer control of paper basis weight by automated slice lip contour control.

To provide slice lip contour control the general developments have been to reduce backlash by using wear resistant material and improved couplings and to improve the positioning by using higher gear ratios in the screw jack, improved position indicators and better motor control.

These improvements have led to greater accuracy but further improvements are believed to be necessary if ideal cross machine automatic basis weight control through slice lip contour control is to be achieved.

An exception to the above general approach is a system available under the trade mark THERMATROL. This system features a rod that is electrically heated on parts of its periphery. The heating is controlled by varying the voltage to the heating element around the rod. As the rod expands and contracts with change in temperature quite good slice lip contour control is achieved. Backlash from motor couplings and screw jacks threads and the like is eliminated and the system lends itself to simple computer control. However, disadvantages remain. There is the disadvantage of thermal drift. Metal rod conductivity causes heating of the rod and the connections outside the heating zone. Variations in the ambient air temperature and velocity cause variations in the effective length of the rods and thus interfere with the performance of the control system. There is also backlash at the connection of the rod with the lip and, indeed, the THERMATROL system appears to provide no advantage over the prior art in this regard.

SUMMARY OF THE INVENTION

The present invention seeks to provide a sensitive control mechanism that is particularly applicable in the control of the slice lip contour in a paper making machine head box.

Accordingly, in a first aspect, the present invention is a control mechanism comprising a first vessel, a substantially incompressible liquid within the vessel; means to vary the temperature of the incompressible liquid; an expansible member communicating with the first vessel and also full of a substantially incompressible liquid whereby increasing the temperature of the incompressible liquid in the first vessel expands liquid from the first vessel towards the expansible member to expand that member. To properly control expansion of the expansible member, the liquid must not be heated above its boiling point.

In a more specific aspect the invention is a control for a lip of a head box slice the control comprising: a first vessel; an incompressible liquid in the first vessel; means to heat the liquid; a second vessel able to expand; a passageway communicating the first vessel and the second vessel; an incompressible fluid in the second vessel; a member movable by the second vessel and attached at its end remote from the second vessel to the lip of the head box slice whereby heating of the incompressible liquid in the first vessel (to a temperature lower than its boiling point) causes expansion of that liquid to pass along the passageway into the second vessel to move the member and thus the lip.

BRIEF DESCRIPTION OF THE DRAWINGS

Aspects of the invention are illustrated, merely by way of example, in the accompanying drawings in which:

FIG. 3 is a detail of an embodiment of the invention;

FIG. 4 is a detail of a further embodiment of the invention; and

DESCRIPTION OF THE PREFERRED EMBODIMENTS

Figure 1:
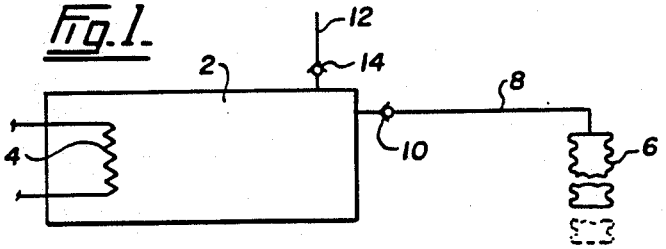
FIG. 1 is a schematic view indicating one concept of the invention.

In the drawings FIG. 1 shows a control mechanism comprising a first vessel 2 containing a substantially incompressible liquid. There are means to vary the temperature of the incompressible liquid in the form of a heating element 4. There is an expansible member 6 communicating with the first vessel 2 and also full of substantially incompressible liquid. The first vessel and the expansible member communicate through a pipe 8.

The illustrated embodiment of FIG. 1 includes a first check valve 10 in the pipe 8 so that flow cannot reverse back to the first vessel 2. Furthermore, there is a pipe 12 to supply incompressible liquid to the first vessel 2. That second pipe 12 contains a check valve 14 so that the incompressible liquid may not expand out through the second pipe 12 when the liquid is heated. The check valves 10 and 14 are not an important feature of the invention. Both the second pipe 12 and both check valves 10 and 14 can be dispensed with so that the incompressible liquid moves from the first vessel 2 to the expansible member 6 when it is heated and contracts back into the first vessel when it cools.

The expansible member 6 comprises a bellows like structure having side walls that are flexible. The arrangement is such that as the liquid is heated in the first vessel it expands and moves towards the expansible member. The expansible member is thus extended as illustrated in FIG. 1.

It should be noted that a common incompressible liquid, for example, water, may be used in the system. Alternatively, there may be two different incompressible liquids and, for example a flexible heat barrier, not shown, can be installed in the system to provide a barrier between the heating and nonheated liquid.

Figure 2:
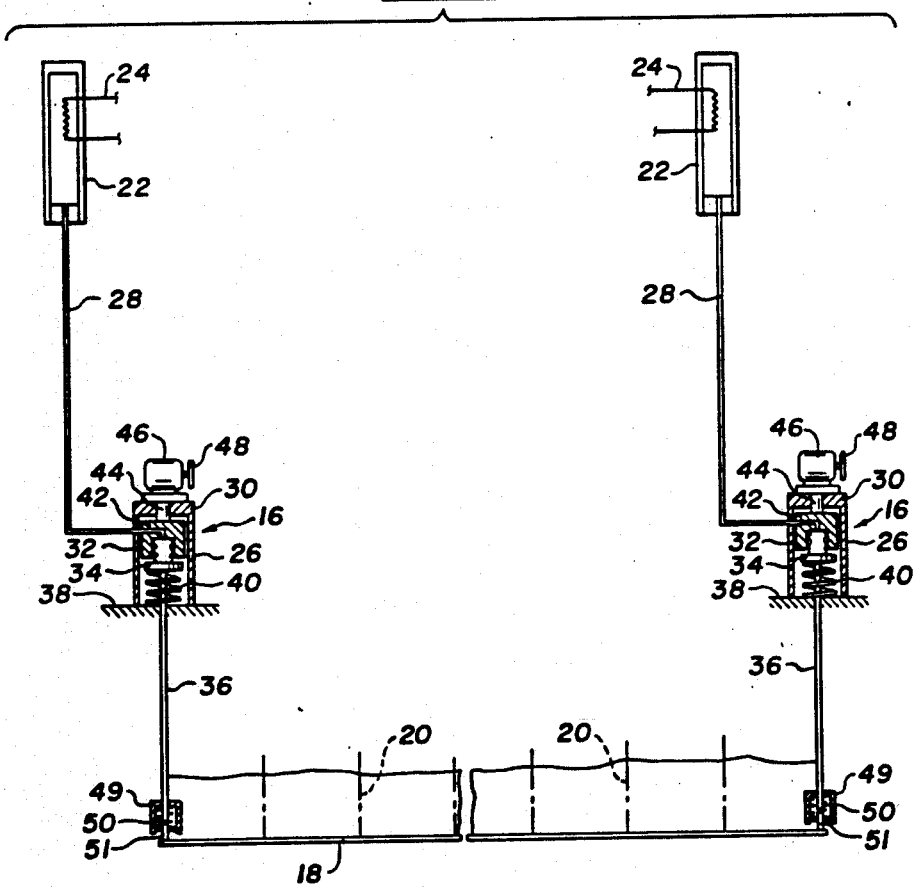
FIG. 2 is a schematic view illustrating the invention applied to a head box.

FIG. 2 illustrates the attachment of control mechanism 16 according to the present invention to the upper lip 18 of a head box slice. Two control mechanisms 16 are shown although as indicated by the broken lines 20 a plurality of such members, typically, for example at 4 to 12 inch centres are used across the width of the lip 18.

Each control mechanisms comprises a first vessel 22 containing an incompressible liquid and a coil 24 within the vessel 22 to heat the incompressible liquid. There is a second vessel 26 able to expand and a pipe 28 communicates the vessels 22 and 26. There is an incompressible fluid in the second vessel, indeed in the illustrated embodiment of FIG. 2 the same liquid is used in both vessels 22 and 26. Demineralized water is a preferred liquid because it is readily available and causes negligible problems if spilled in a paper mill.

In the embodiment of FIG. 2 the second vessel 26, which is illustrated as a simple bellows, is located within a housing 30 having side walls 32, through one of which the pipe 28 passes. There is a first piston 34 located within the housing 30 and movable by expansion of the second vessel 26. There is a member in the form of a connecting rod 36 movable by the first piston 34 when the second vessel 26 expands. The connecting rod 36 is attached at its end remote from the housing to the lip 18.

There is a base 38 to the housing, opposed to the piston 34, and a spring 40 is interposed between the piston 34 and the base 38 to urge the piston away from the base, that is against the force of the expanding second vessel 26. The expansible second member 26 is positioned within a second piston 42 attached by a rod 44 to a conventional screw jack 46 having a hand wheel 48. By rotation of the wheel 48 the simple screw jack mechanism, not shown, operates to move the second piston 42 downwardly or to allow the spring 40 to force it upwardly, remembering that the spring 40 tends to urge the first piston upwardly 34. The screw jack 46 provides coarse control. That is the lip position can be adjusted initially by the screw jack 46 and then fine adjustment can be carried out by controlling the temperature of the incompressible liquid in the first vessel 22.

FIG. 2 also illustrates the use of antibacklash mechanisms in the form of spring boxes 49 formed at the base of the connecting rods 36 at a pivotal junction 50 with rods 51 attached to the lip 18. This is a means of eliminating any backlash in the system. In addition a solid link to the lip 18 can be used obviating the necessity for backlash control.

The embodiment of FIG. 2 functions as follows. When it is desired to locate the lip 18 an initial coarse adjustment is carried out by operation of the screw jack 46 acting through rod 44, piston 42, piston 34 and rod 36 to fix a first, coarse position. During operation of the device minute control is available by sensing the position of the lip 18 and varying the temperature of the incompressible liquid within the first vessel 22. As the incompressible liquid is heated by coil 24 it expands through pipe 28 into the second vessel 26. The second vessel 26, on expanding, moves the piston 34 and thus the rod 36 downwardly to move the lip 18 downwardly. On contraction, that is on cooling of the liquid, spring 40 acts to move piston 34 up and thus rod 36 and lip 18. The fluid meanwhile contracts back into the first vessel 22, indeed the spring 40 can be considered merely taking up the slack as the incompressible liquid contracts.

FIG. 3 illustrates in detail a control mechanism according to the invention. There is a first vessel 52 filled with an incompressible liquid and having a heating coil 54. A pipe 56 extends from the first vessel 52 to an expansible, second vessel 58 within an inverted hollow piston 60 located within a second piston 62 in a housing or cylinder 64. The pipe 56 extends through an opening 66 in one wall of the cylinder 64. A third piston 68 abuts the second piston 62. A connecting rod 70 is threadedly engaged in piston 68. There is a spring 72 located between the piston 68 and the base 74 of the cylinder 64 and urging the pistons 60, 62 and 68 upwardly, that is against the expansion of the second vessel 58. The cylinder 64 has a top 76 and a connecting rod 78 extends through the top 76 to connect with a screw jack (not shown) in the same arrangement as shown in FIG. 2.

The FIG. 3 embodiment operates by heated liquid expanding from the vessel 52 to the vessel 58. That moves pistons 60 and 68 downwardly acting to move the connecting rod 70 downwardly against the urging of the spring 72. Coarse adjustment is, as in the FIG. 2 embodiment, carried out by preliminary use of the screw jack attached to the shaft 78.

In the FIG. 4 embodiment the expansible member is a bellows 80 located between inexpansible members 82. These members 82 ensure that expansion of the bellows 80 acts to move pistons 84 and 86 downwardly as in the FIG. 3 embodiment. Again there is a further piston 88 slidably located on the members 82 and attachable, if desired, to a screw jack (not shown) for coarse adjustment. The other components in FIG. 4 are as in FIG. 3.

Figure 5:
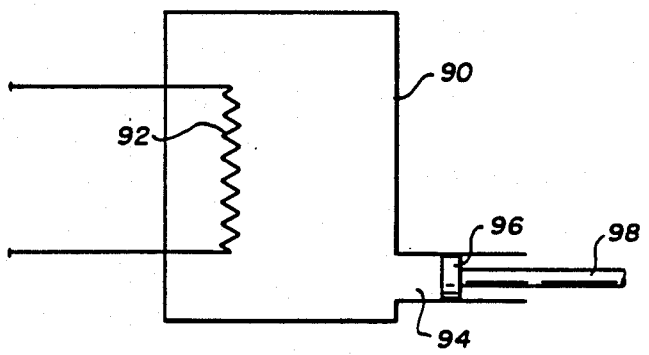
FIGS. 5 and 6 illustrate further embodiments of the invention.
Figure 6:
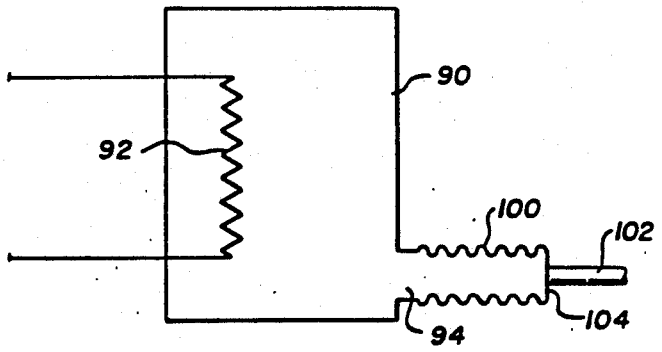

FIGS. 5 and 6 illustrate a first vessel 90 containing substantially incompressible liquid. There is a heating coil 92 within each vessel 90 to heat the incompressible liquid. In both embodiments there is an ante-chamber 94 into which the incompressible liquid flows. In the FIG. 5 embodiment the ante-chamber is closed with a piston 96 from which a rod 98 extends. In the FIG. 6 embodiment the ante-chamber 94 has expansible walls 100 and a connecting rod 102 is attached to the end wall 104 of the ante-chamber. In these embodiments expansion of the fluid by heating moves the piston 96 or the walls 100 outwardly so that the connecting rods 98 and 102 which are attached to a mechanism to be adjusted or otherwise moved, are moved outwardly.

The present invention provides extremely accurate adjustment of the position of, for example, a head box slice lip. It should be noted that the heated vessel is always of a substantially larger volume than the expansible member, providing excellent sensitivity. In any event the magnitude of movement of the expansible vessel can be adjusted for any application by simply changing the volume of the larger container. The greater the volume of the first vessel the greater the change in volume and expansion for any given temperature difference.

In addition to providing a system capable of precise control the system need not be subject to thermal drift as described above for the Thermatrol system. A relatively large first vessel can be located in an area that has a controlled environment. When the incompressible liquid is heated it will expand and be displaced towards the expansible vessel. The temperature of the fluid in the expansible member and in the passageway leading to that member is not directly effected by the heater in the first vessel as it is simply pushed forward by the expanding liquid. As indicated a flexible heat barrier can be installed in the system to provide a heat barrier between the heating and nonheating liquid and to permit the use of separate liquids in both members.

Changes in the temperature in the environment in which the expansible member is operating will have negligible effect on the expansible member as the volume of liquid contained in it and in the passageway leading to it is small. For example if, as in a typical case, the volume of the first vessel is about 50 times greater than the volume of the expansible member and passageway any change in temperature in the expansible member and passageway will be reduced by a factor of 50 to 1 compared to the same temperature change in the first vessel. This is not the case for the THERMATROL system described above where any change in temperature of the rod used in that system will reflect in a change of length in the rod that is directly proportionate to the temperature change.

Where thermal drift is not a serious consideration the first vessel and the expansible element can be constructed as an integral unit, that is the expansible member can be in effect an ante chamber to the first vessel with an actuator, for example a connecting rod, extending from it as in FIGS. 5 and 6.

The control of the slice lip on a head box the expansible member can be controlled by a machine computer. The sheet basis weight measurement can be used to determine any correction that may be required to the slice lip profile. The computer would determine the required temperature of the incompressible liquid within the first vessel and control the temperature to accomplish a corresponding movement of the expansible member and thus, of course, of the lip.

The spring loaded control members illustrated in FIGS. 2 to 4 provide means of preventing damage to the profiling lip. Without such a resilient arrangement it is possible to exceed the maximum permissible displacement between the slice lip adjusters. By selecting the appropriate spring range for any given slice lip design the maximum permissible deflection of the lip, relative to adjacent slice slip adjusters, cannot be exceeded because the spring would deflect at the point of maximum permissible slice lip deflection and thus control the maximum differential displacement of the lip between adjacent adjusters.

I claim:

1. A control for a lip of a head box slice, the control comprising:

a first vessel;

an incompressible liquid in the first vessel;

a heating element within the first vessel to vary the temperature of the liquid in a controllable manner within any range whose upper limit is below the boiling point of said incompressible liquid;

a second vessel able to expand;

an incompressible fluid in the second vessel;

a passageway communicating between the first vessel and the second vessel;

a member movable by the second vessel and attached at its end remote from the second vessel to the lip of the head box slice whereby heating of the incompressible liquid in the first vessel causes expansion of that liquid to pass along the passageway into the second vessel to move the member in a direction toward the lip, and whereby cooling of the incompressible liquid in the first vessel causes liquid from the second vessel to flow into the passageway to move the member in a direction away from the lip.

2. A control as claimed in claim 1 in which the second vessel is located within a housing comprising side walls;

a first piston movable by expansion of the second vessel, said first piston being attached to the member to provide the necessary movement to that member.

3. A control as claimed in claim 2 in which the housing has a base opposed to the piston;

resilient means between the piston and the base to urge the piston away from the base, against the force of the expanding second vessel.

4. A control as claimed in claim 3 in which the resilient means is a spring.

5. A control as claimed in claim 2 including a screw jack attached to the control for coarse control of the lip position;

the screw jack being attached to a second piston within said housing, the second piston acting to move the first piston and thus establish coarse control of the lip position.

6. A control as claimed in claim 1 including a screw jack attached to the control for coarse control of the lip position.

7. A control as claimed in claim 1 attached to the lip by a spring connector to eliminate backlash.

* * * * *